United States Patent [19]

Crall

[11] 3,991,730

[45] Nov. 16, 1976

[54] NOISE IMMUNE RESET CIRCUIT FOR RESETTING THE INTEGRATOR OF AN ELECTRONIC ENGINE SPARK TIMING CONTROLLER

[75] Inventor: Frederick William Crall, Farmington, Mich.

[73] Assignee: Chrysler Corporation, Highland Park, Mich.

[22] Filed: Jan. 30, 1975

[21] Appl. No.: 545,275

[52] U.S. Cl. ..... 123/117 R; 123/148 E

[51] Int. Cl.[2] ..... F02P 1/00

[58] Field of Search ..... 123/117 R, 148 E, 148 MCD, 123/148.5 A

[56] References Cited

UNITED STATES PATENTS

| | | | |
|---|---|---|---|
| 2,785,215 | 3/1957 | Yetter | 123/148 E |
| 3,314,407 | 4/1967 | Schneider | 123/148 E |
| 3,592,178 | 7/1971 | Schiff | 123/117 R |
| 3,605,713 | 9/1971 | LeMasters et al. | 123/148 E |
| 3,660,689 | 5/1972 | Oishi et al. | 123/148 E |
| 3,749,070 | 7/1973 | Oishi et al. | 123/117 R |
| 3,811,420 | 5/1974 | Vogel | 123/117 R |
| 3,824,977 | 7/1974 | Cambell et al. | 123/148 E |
| 3,867,916 | 2/1975 | Bigalke | 123/117 R |
| 3,874,351 | 9/1975 | Asler et al. | 123/117 R |
| 3,885,534 | 5/1975 | Webster | 123/117 R |
| 3,910,243 | 10/1975 | Gau et al. | 123/148 E |
| 3,923,029 | 12/1975 | Polo | 123/148 E |

*Primary Examiner*—Charles J. Myhre
*Assistant Examiner*—Paul Devinsky
*Attorney, Agent, or Firm*—Talburtt & Baldwin

[57] ABSTRACT

A pickup operatively coupled with an internal combustion engine develops a train of bi-polar pulses wherein each bi-polar pulse is generated at a predetermined engine crank angle and each bi-polar pulse comprises a leading pulse portion of one polarity and a trailing pulse portion of opposite polarity. A bi-stable circuit is switched to a set condition in response to a given magnitude of the trailing pulse portion of each bi-polar pulse and is switched to a reset condition in response to a given magnitude of the leading pulse portion of each bi-polar pulse. A monostable circuit is operatively coupled with the bi-stable circuit to provide an output pulse of predetermined duration in response to the switching of the bi-stable circuit from the reset to the set condition. A transistor has its emitter-collector circuit connected across the capacitor of the engine spark timing controller integrator circuit and its base terminal connected to the output of the monostable circuit. The output pulse of the monostable circuit causes the transistor to switch into conduction to thereby short circuit the capacitor and reset the integrator. The circuit is highly immune to spurious triggering due to noise and provides rapid, accurate resetting of the integrator at the predetermined engine crank angles.

3 Claims, 2 Drawing Figures

NOISE IMMUNE RESET CIRCUIT FOR RESETTING THE INTEGRATOR OF AN ELECTRONIC ENGINE SPARK TIMING CONTROLLER

BACKGROUND AND SUMMARY OF THE INVENTION

The present invention pertains to electronic engine spark timing controllers and in particular to a noise immune reset circuit for resetting an electronic spark timing controller of the type having an integrator circuit which is periodically reset at predetermined engine crank angles.

In one type of engine spark timing controller, an integrator circuit provides a crank position signal representative of the engine crank angle. The integrator is periodically reset at predetermined crank angles, for example, being reset every 90° of engine crank angle for an 8 cylinder engine and every 120° of engine crank angle for a 6 cylinder engine. The integrator circuit, therefore, generates a saw-tooth type waveform which is representative of the engine crank angle over the full range of engine operating speeds. In order to achieve optimum performance in such an electronic spark timing controller, it is important that the integrator always be accurately reset. Accuracy in resetting can be attained by rendering the circuit immune to spurious triggering due to extraneous electrical noise picked up by the system.

The present invention is directed toward a reset circuit for resetting the integrator of an electronic engine spark timing controller which is highly immune to noise and which provides accurate resetting of the integrator at predetermined engine crank angles. By way of example, an electronic spark timing controller of the type having an integrator with which the present invention may be practiced is disclosed in U.S. patent application Ser. No. 388,673 filed Aug. 15, 1973, and assigned to the same assignee as the present application. Features and advantages of the present invention will be seen in the ensuring description and claims which are to be taken in conjunction with the accompanying drawing.

BRIEF DESCRIPTION OF THE DRAWING

The drawing illustrates a preferred embodiment of the present invention according to the best mode presently contemplated in carrying out the invention.

DESCRIPTION OF THE PREFERRED EMBODIMENT

Figure 1:
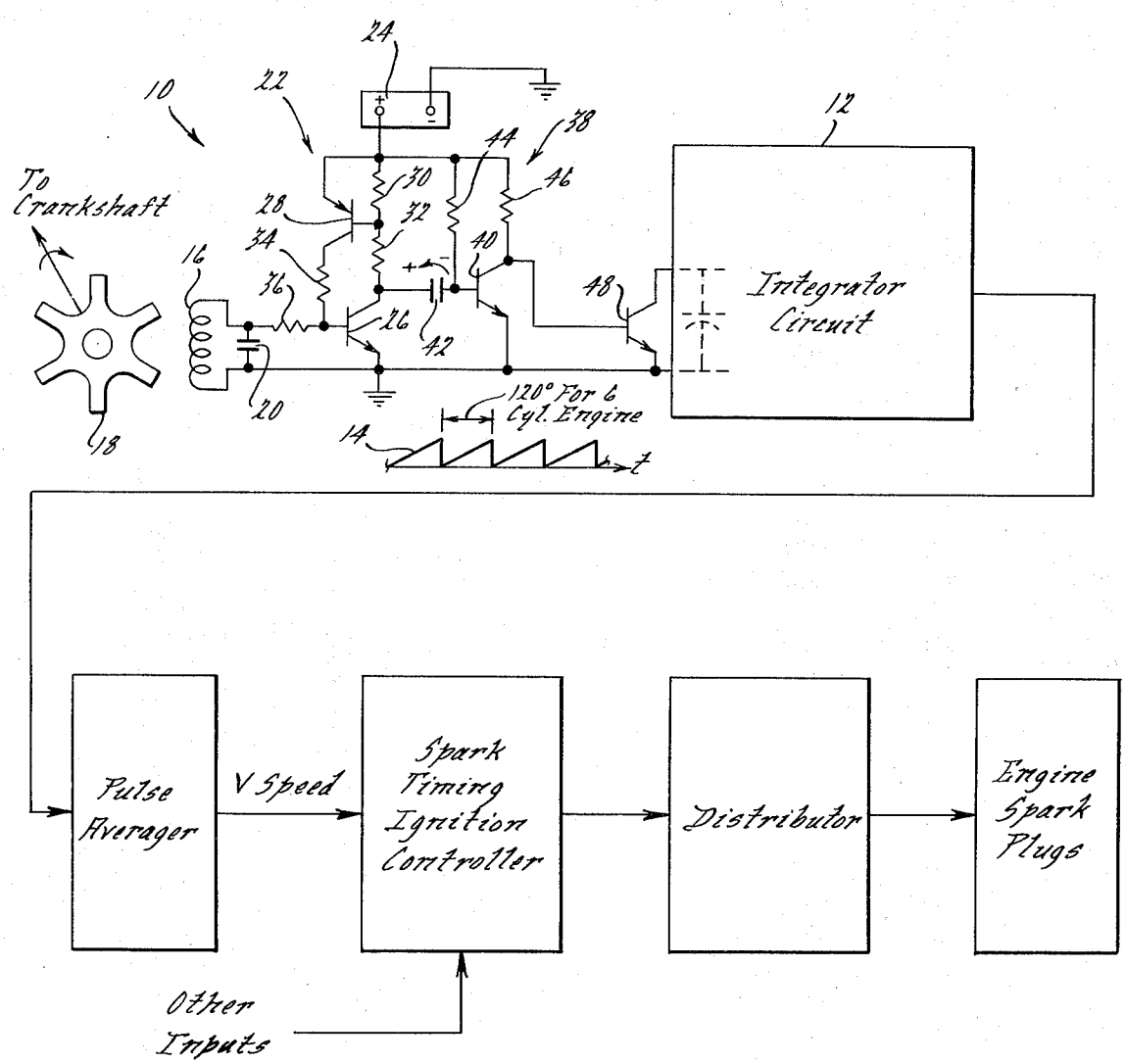
FIG. 1 is a schematic diagram illustrating an electronic engine spark timing controller embodying an integrator reset circuit according to principles of the present invention.
Figure 2:
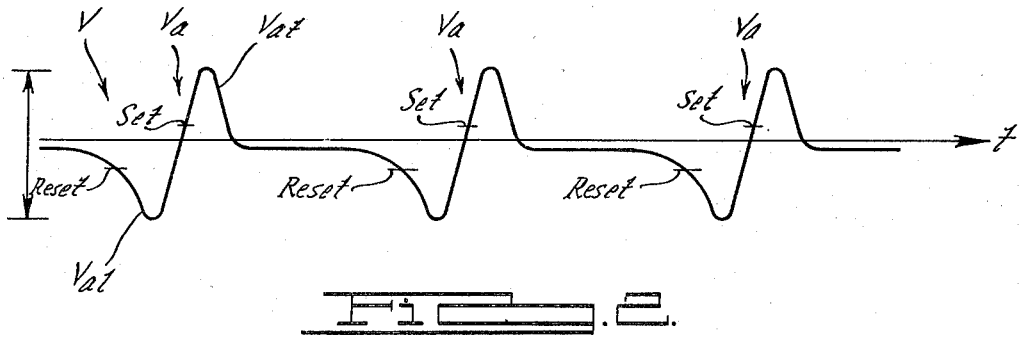
FIG. 2 illustrates a waveform useful in explaining the operation of the reset circuit of FIG. 1.

As shown in FIG. 1, an electronic spark timing controller 10 includes an integrator circuit 12 which is reset at predetermined engine crank angles to develop a sawtooth output waveform 14 whose magnitude is representative of the engine crank angle and whose frequency is representative of engine speed. A detailed description of this type integrator is available in the above-mentioned application. The novel integrator reset circuit according to the present invention comprises a pickup coil 16 in which a train of bi-polar pulses is induced by a toothed reluctor wheel 18 which is operatively coupled with the engine crank shaft to rotate in synchronism therewith. The reluctor wheel is designed so that a pulse train, such as pulse train V shown in FIG. 2, is developed in pickup coil 16. An illustrative pickup is disclosed in U.S. Pat. No. 3,749,974 issued July 31, 1973 and assigned to the same assignee as this present application. Each bi-polar pulse $V_a$ comprises a leading negative-going portion $V_{al}$ which is immediately followed by a trailing positive-going pulse portion $V_{at}$. The bi-polar pulses are spaced apart a predetermined number of engine crank angle degrees, for example, 90° for an 8 cylinder engine and 120° for a 6 cylinder engine. A capacitor 20 is shunted across pickup coil 16 to remove very high frequency noise from the pulse train. The pulse train V is supplied to a bi-stable circuit 22.

Bi-stable circuit 22 is energized from a D.C. power supply 24 and is switched between a reset and a set condition in accordance with the bi-polar pulses generated in pickup coil 16. More particularly, bi-stable circuit 22 comprises a main NPN transistor 26, a regenerative transistor 28 and four resistors 30, 32, 34 and 36. The base-emitter circuit of main transistor 26 is operatively coupled with pickup 16 to receive the train of pulses therefrom. Specifically, the emitter of transistor 26 is connected to the ground side of pickup 16 while the other side of pickup 16 connects through resistor 36 to the base of transistor 26. Resistors 30 and 32 connect is series from the collector of transistor 26 to the positive terminal of power supply 24. Re-generative transistor 28 has its emitter connected to the positive terminal of the power supply, its collector connected through resistor 34 to the base of transistor 26 and its base connected to the junction of resistors 30 and 32. If it is assumed that no pulses are being developed in pickup 16, then circuit 22 assumes a reset condition wherein neither transistor is conducting. Assuming that pulses now are developd in pickup 16, the bi-stable circuit remains in the reset condition during the leading negative-pulse portion of the first bi-polar pulse. As the bi-polar pulse begins to swing positive a point is reached where the base-emitter junction of transistor 26 becomes forward biased thereby rendering the transistor conductive. As transistor 26 becomes increasingly conductive the voltage at the junction of resistors 30 and 32 becomes less positive thereby biasing the emitter-base circuit of transistor 28 for conduction. As transistor 28 becomes increasingly conductive, additional base current for transistor 26 now begins to flow through the emitter-collector circuit of transistor 28 and resistor 34. From this description it can be seen now that transistor 28 produces a re-generative effect on the circuit whereby transistor 26 is switched rapidly from non-conduction to full conduction. Because of the additional base current flow into transistor 26 through transistor 28 and resistor 34, transistor 26 cannot be switched back into a non-conducting condition by the same magnitude of signal from pickup coil 16. Specifically, the signal from pickup coil 16 must begin to swing somewhat negative before transistor 26 can be switched back to a non-conducting condition. Hence, it can be appreciated that the bi-stable circuit will be reset only when the leading pulse portion of the next bi-polar pulse occurs. FIG. 2 illustrates the setting and resetting of the bi-stable circuit by waveform V.

A monostable circuit 38 is operatively coupled with bi-stable circuit 22. Monostable circuit 38 comprises an NPN transistor 40, a capacitor 42 and a pair of resistors 44 and 46. The emitter of transistor 40 is connected to ground and the collector is connected through resistor 46 to the positive terminal of power supply 24. Resistor 44 connects from the positive terminal of power supply 24 to the base of transistor 40 and capacitor 42 connects from the base of transistor 40 to the collector of transistor 26. With bi-stable circuit 22 in the reset condition, the potential at the collector of transistor 26 is approximately the positive supply voltage. Since transistor 40 is biased by resistor 44 for conduction, the potential at the base of transistor 40 is slightly above ground potential. Therefore, capacitor 42 is positively charged to almost full supply voltage in the direction illustrated by the arrow. Therefore, when bi-stable circuit 22 is suddenly switched to the set condition, a large negative voltage is applied to the base of transistor 40 thereby rapidly cutting off transistor 40 to raise the potential at its collector to almost full supply voltage. Since transistor 26 is now conducting, power supply 24 will tend to charge capacitor 42 in the opposite direction through resistor 44 and the collector-emitter circuit of transistor 26. When the potential at the base of transistor 40 becomes slightly positive relative to ground, transistor 40 begins to conduct thereby rapidly switching its collector voltage back to just above ground potential. When bi-stable circuit 22 is again reset, transistor 26 becomes non-conducting and the capacitor 42 will again charge to essentially full supply voltage in the illustrated polarity before the bi-stable circuit is again set. Thus, with the two circuits 22 and 38, a positive going pulse of predetermined duration is developed at the collector of transistor 40 in predetermined relation with the bi-polar pulses of the pulse train generated in pickup 16. Because bi-stable circuit 22 must be reset before a subsequent pulse can be given by monostable circuit 38 and because bi-stable circuit 22 is not actually reset until appreciable magnitude of the leading negative polarity portion of the bi-polar pulse has developed, the circuit is rendered highly immune to any noise which might occur between the bi-polar pulses. In this way, accurate and reliable generation of the output pulses of the monostable circuit is attained.

In order to reset the integrator, a transistor 48 is shunted with the integrator capacitor. The transistor 48 is under the control of the output pulse from monostable 38. More specifically, transistor 48 has its emitter-collector circuit connected directly across the integrator capacitor and the base of the transistor is connected to the collector of transistor 40. Hence transistor 48 is switched into conduction during the output pulse from the monostable circuit 38. With the transistor 48 switched into conduction, the accumulated charge on the capacitor is rapidly dissipated thereby resetting the integrator. The circuit components are selected such that the duration of the output pulse from monostable circuit 38 is comparatively short (i.e., 1° or 2° of crank angle max.) relative to the engine crank angle displacement between consecutive reset pulses.

The remainder of FIG. 1 shows in block diagram from the remainder of the engine spark timing controller. Since the details thereof do not pertain to the present invention, reference may be had to the aforementioned application U.S. Ser. No. 388,673, if the reader desires such details.

What is claimed is:

1. In combination:

an internal combustion engine having an electronic spark timing controller of the type having an integrator circuit which provides a crank position signal and which is periodically reset at predetermined engine crank angles;

pick-up means operatively coupled with the engine for developing a train of bi-polar pulses wherein each bi-polar pulse is generated at a predetermined crank angle and each bi-polar pulse comprises a leading pulse portion of one polarity and a trailing pulse portion of opposite polarity;

a D.C. power supply having a pair of terminals;

a bi-stable circuit means energized from said power supply and operatively coupled with said pick-up means to receive said train of bi-polar pulses, said bi-stable circuit means comprising a first bi-polar transistor of one conductivity type having its base-emitter circuit operatively connected with said pick-up means to receive said bi-polar pulses and having its emitter-collector circuit operatively connected in series with a pair of series-connected resistors across said power supply, a second transistor of conductivity type opposite that of said first transistor having its base-emitter circuit operatively connected across one of said resistors and having its emitter-collector circuit connected through a third resistor from a terminal of said power supply to the base of said first transistor whereby said first transistor has the voltage signal appearing at one of its emitter and collector terminals switched from a first signal level to a second signal level in response to a given magnitude of said trailing pulse portion of each bi-polar pulse and from said second signal level to said first signal level in response to a given magnitude of said leading pulse portion of each bi-polar pulse;

an RC monostable circuit means including a timing capacitor and a transistor with said capacitor being directly electrically connected between the terminal of said first transistor at which said voltage signal appears and the base terminal of said monostable transistor whereby said monostable transistor generates an output pulse of predetermined width in response to switching of said voltage signal from said first signal level to said second signal level; and electronic switch means operatively coupled with said monostable transistor and said integrator circuit for resetting said integrator circuit in response to said output pulse of said monostable transistor.

2. The combination of claim 1 wherein said integrator circuit includes a capacitor and said electronic switch means is connected across said capacitor.

3. The combination of claim 2 wherein said electronic switch means comprises a transistor.

* * * * *